US005288420A

United States Patent [19]

Mandy

[11] Patent Number: 5,288,420

[45] Date of Patent: Feb. 22, 1994

[54] SOLID LAUNDRY PRE-SPOTTER COMPOSITION AND METHOD OF USE

[75] Inventor: John C. Mandy, Woodbridge, N.J.

[73] Assignee: Fluid Packaging Company, Inc., Lakewood, N.J.

[21] Appl. No.: 901,785

[22] Filed: Jun. 22, 1992

[51] Int. Cl.[5] ..... C11D 9/60; C11D 17/00; D06L 1/08; D06L 1/16

[52] U.S. Cl. ..... 252/121; 8/137; 8/142; 252/122; 252/132; 252/134; 252/174; 252/174.12; 252/174.21; 252/558; 252/559; 252/DIG. 12; 252/DIG. 16; 435/264

[58] Field of Search ..... 252/121, 122, 558, 559, 252/174.11, 174.12, 174.21, 174.22, 132, 134, 174, DIG. 12, DIG. 16; 8/137, 142; 435/264

[56] References Cited

U.S. PATENT DOCUMENTS 3,953,353 4/1976 Barrett, Jr. et al. ..... 252/174
4,289,644 9/1981 Steinhauer et al. ..... 252/127
4,636,328 1/1987 Flynn et al. ..... 252/90
4,842,762 6/1989 Sabol, Jr. et al. ..... 252/109

*Primary Examiner*—Dennis Albrecht
*Attorney, Agent, or Firm*—Fitzpatrick, Cella, Harper & Scinto

[57] ABSTRACT

A stearate-matrix, pre-spotter composition in solid, stick form to be applied by direct contact to stained areas of fabric, thereby transferring the composition to the stained areas of the fabric. The composition includes an alkyl aromatic sulfonic acid and/or sulfonate, at least one nonionic surfactant and an enzyme uniformly dispersed throughout a semi-hard stearate matrix. The composition optimizes the pH to promote enzyme action, while simultaneously achieving a satisfactory drop point for shipping and warehousing. Hardness and transferability are achieved at a low pH level that was previously not thought to be possible without the addition of various salts.

71 Claims, No Drawings

SOLID LAUNDRY PRE-SPOTTER COMPOSITION AND METHOD OF USE

BACKGROUND OF THE INVENTION

A. Field of the Invention

The present invention relates to a solid type fabric-cleaning product that is useful as a pre-applied spotting agent used prior to laundering or dry cleaning to facilitate the removal of stains and soil from selected pre-treated areas of the fabric. More particularly, the invention is directed to a solid laundry pre-spotter composition that includes sodium stearate, propylene glycol, a polyethylene glycol, an alkyl aromatic acid, a strong base, non-ionic surfactants, an enzyme, and water.

B. Description of the Prior Art

Compositions have long been used as pre-spotting preparations in the laundering and cleaning field. Such preparations have been applied to particular, selected stained or excessively soiled portions of clothing and other fabrics prior to laundering. Effective pre-treatment of this type increases the likelihood of removing the soils and stains from the fabric during the cleaning process.

Some of the pre-spotting compositions have included laundry enzymes of the type that have been shown to enhance the removal of foreign material, such as oil stains, other stains, and soil from fabrics. When enzyme systems are used, they are critically sensitive to the pH of the composition into which they are introduced.

Prior art "stain sticks" pre-spotting compositions have included those having a sodium stearate matrix. However, those skilled in the art have long tried, and yet failed, to formulate a product which is a firm solid having an acceptable drop point, yet yielding when manual pressure is applied, and also has a pH below about 9.8, a value reasonably expected to be compatible with enzyme activity. As discussed extensively in Sabol, Jr. et al., U.S. Pat. No. 4,842,762 issued Jun. 27, 1989, many of the stick-type products based on sodium stearate have failed to achieve a good working balance of physical properties, such as hardness and drop point, with the necessary chemical properties, such as a pH that falls within a range that is acceptable for enzyme activity.

Sabol, Jr. et al. recommends the formation of sodium stearate in situ and the addition of various salts to selectively modify particular physical and chemical parameters of the composition, including texture, consistency, hardness, melting point and, pH, to optimize the rheology and the softening range of the product. In particular, Sabol, Jr. et al. teaches that the addition of a certain class of salts within a critical concentration range of from 1 to 4% by weight is necessary to achieve good physical and chemical properties for this type of product.

SUMMARY OF THE INVENTION

It has now been discovered that it is not necessary to add a critical concentration of a salt to a sodium stearate type matrix composition, such as taught by Sabol et al., to achieve a good balance of physical and chemical properties. Specifically, a stearate pre-spotter composition has now been discovered that provides adequate drop point, hardness, and transferability at a lower pH, thus enhancing enzyme activity. By providing superior hardness for use at a pH level as low as 9.0, the composition provides the advantage of greater enzyme activity while simultaneously providing harder, more rigid solid stick, which allows application with a greater pressure, resulting in a greater penetration of the composition into the stained fabric. At I5 the same time, the drop point is maintained at higher levels than previously thought possible at this lower pH, making feasible the shipping and storage of the improved composition, even under less than ideal temperature conditions.

One aspect of the present invention is a laundry soil and stain remover composition in applicator stick form for application to fabric as an aid in laundering, wherein the composition comprises:

A. from about 11 to about 15% by weight of sodium stearate;

B. from about 8 to about 11% by weight of propylene glycol;

C. from about 4 to about 7% by weight of a polyethylene glycol

D. from about 12 to about 20% by weight of a alkyl aromatic sulfonic acid surfactant, an alkyl aromatic sulfonate surfactant that has been formed in situ by the reaction of said alkyl aromatic sulfonic acid with a strong base, or a mixture thereof;

E. from about 2 to about 6% by weight of a strong base capable of reacting in situ with said alkyl aromatic sulfonic acid surfactant to form a semi-solid sulfonate product;

F. from about 20 to about 35% by weight of at least one nonionic surfactant, wherein the nonionic surfactant is different from the alkyl aromatic sulfonic acid surfactant or the alkyl aromatic sulfonate surfactant above;

G. from about 2 to about 10% by weight of an enzyme; and

H. from about 24 to about 30% by weight water.

The composition of the invention has a pH of between about 9.0 and about 9.6, a drop point of greater than about 115° F., and a penetrometer reading of at least about 55 units (5.5

Another aspect of the invention involves a process for cleaning fabric that has soiled portions, the process comprising the steps of:

a. applying to the soiled portions of the fabric, prior to cleaning, the soil and stain remover composition of the invention, and b. cleaning the soiled fabric to which said composition has been applied by laundering or dry cleaning.

Contrary to the teachings of the art, the composition of the invention has a stearate matrix and yet achieves an optimum pH for the action of an enzyme system, while simultaneously maintaining an acceptably high drop point and hardness, while simultaneously facilitating the transfer of the compound to the stained fabric. This is a combination of physical and chemical characteristics that is contrary to what is normally observed and customarily believed to be possible when working with stearate matrix formulations.

Specifically, if the pH in such formulations is controlled within the optimum range for enzyme action, the drop point and transferability are typically less than satisfactory for the intended end use. Unexpectedly, the present invention allows one to control the pH within the 9.0 to 9.8 range critical to enzyme action, while simultaneously achieving a drop point in excess of 115° F. or more, and achieving a superior transferability and penetration of the stick composition to the stained fabric, as evidenced by a desirable waxy sheen on the stained portions to which the composition has been applied.

DETAILED DESCRIPTION OF THE INVENTION

The laundry soil and stain remover composition of the invention, which is in applicator stick form, comprises from about 11 to about 15% by weight of sodium stearate, preferably about 12%. Sodium stearate is used in a number of solid consumer products that are sold in applicator stick form because of the ability of sodium stearate to form a dense solid when combined with other liquid ingredients, such as propylene glycol and water. Further, under the conditions of the invention, sodium stearate serves to provide a firm but "yielding" matrix of about the right hardness or penetrability for use in the present invention.

The composition of the invention also includes propylene glycol as an organic solvent in the matrix system formed with sodium stearate. The amount of propylene glycol can vary from about 8 to about 11% by weight, preferably about 10%. This amount is significantly lower than the 35 to 40% of propylene glycol that is typically used in prior art formulations of solid, sodium stearate applicator sticks.

At least one polyethylene glycol is used for the composition as a softener. Useful amounts vary from about 4 to about 7% by weight and are preferably about 5%. This amount is significantly higher than the 1 to 2% by weight typically used in prior art formulations. Useful polyethylene glycols have a molecular weight of at least about 3,000, preferably between about 3,000 and about 20,000 and, most preferably, about 20,000. The melting point of useful polyethylene glycols should preferably be between about 129° F. to about 147° F. to provide a smooth melt as the composition is being prepared. In an especially preferred embodiment the polyethylene glycol is one sold by the Union Carbide Company under the trade name PEG 20000 TM (CTFA name, PEG 20M), which has the general formula:

$$H(OCH_2CH_2)_nOH$$

where n has an average value of 20,000.

An alkyl aromatic sulfonic acid, alkyl aromatic sulfonate, or a mixture thereof, is added to the composition. It is believed that this addition acts as an anionic surfactant, particularly when taken in combination with a strong base which, it is believed, neutralizes at least a portion of any sulfonic acid present to form the corresponding sulfonate. Thus, it is believed that the alkyl aromatic sulfonic acid, sulfonate or mixture helps to maintain all solvents and ingredients dissolved in a single aqueous phase. Useful alkyl aromatic sulfonic acids include linear alkyl benzenesulfonic acids, such as ethyl benzenesulfonic acid, ethylamino benzenesulfonic acid, toluene sulfonic acid, xylene sulfonic acid, dodecyl benzenesulfonic acid; mixed linear and nonlinear alkyl benzenesulfonic acids, such as 2-isopropyl-5-methyl benzenesulfonic acid; alkyl naphthalenesulfonic acids, such as methyl naphthalenesulfonic acid, ethyl naphthalenesulfonic acid, isopropyl naphthalenesulfonic acid, and ethylamino naphthalenesulfonic acid. Preferred alkyl aromatic sulfonic acids are selected from the group consisting of alkyl benzenesulfonic acid and alkyl toluenesulfonic acids.

Useful alkyl aromatic sulfonates include the sulfonates corresponding the above-listed sulfonic acids. Preferably, the sulfonates have a cation selected from the group consisting of sodium, potassium, calcium, lithium, magnesium, aluminum and mixtures thereof. In a particularly preferred embodiment, sodium dodecylbenzenesulfonate that is sold by the Pilot Chemical Company under the trade name Calsoft TM is used.

The alkyl aromatic sulfonic acid, sulfonate, or mixture thereof, is present in an amount between about 12 to about 20% by weight, preferably about 15%, as opposed to the lesser 5 to 6% by weight amounts conventionally used in sodium stearate formulations. It is believed that the alkyl aromatic sulfonic acid, when present, is to reacts with a strong base to produce, at least in part, some amount of the corresponding sulfonate, a semi solid product which, it is believed, contributes to the desirably firm but yielding physical quality of the composition.

The strong base present in the composition can be any strong base which is capable of reacting in situ with the alkyl aromatic sulfonic acid or the sulfonic acid corresponding to the alternative alkyl aromatic sulfonate to form a semi-solid sulfonate product. Useful strong bases include alkali metal hydroxides, such as sodium, potassium, calcium, ammonium, or lithium hydroxide; substituted and unsubstituted alkylamines, such as dimethyl amine, dimethyl pentyl amine, t-butyl amine, diethyl amine, diethyl methyl amine, diethanolamine, diisopropyl amine, 2,2-dichlorodiethyl methyl amine, 2,2-diethoxydiethyl methyl amine, ethyl methyl amine, triethanolamine, triethyl amine, diethyl amine and 2-bromotriethyl amine; and mixtures thereof.

The amount of strong base in the composition of the invention should not be so high as to foreclose enzyme activity and should not be so low that hardness is deleteriously affected. Thus, the amount of the strong base can sometimes vary between about 2 to 6% by weight, but preferably is present at a concentration of about 4 to 5 % and, most preferably, about 4.5% by weight.

The composition of the invention preferably includes at least one nonionic surfactant in addition to any alkyl aromatic sulfonic acid or sulfonate that is present. It is believed that the nonionic surfactant assists in the removal of the soil after the soil has been at least partially degraded by the enzyme in the composition. The term nonionic surfactant includes all such surfactants as are commonly understood to be embraced in the laundry and dry cleaning arts. For example, the term includes ethoxylated and propoxylated straight-chain alcohols, such as Texaco L-46-7 TM (CTFA name Surfonic L-46-7), Tergitol 15-5-3 TM (a product of Union Carbide Corporation having a carbon chain length of 15, a secondary alcohol, and the equivalent of 3 ethylene oxide units), and coconut fatty acid monoethanolamide; and phenylalcohols, particularly $C_4$–$C_{12}$ alkyl phenols such as Texaco NP-4 TM (CTFA name Nonoxynol-4) which has the general formula:

$$C_9H_{19}—C_6H_4—(OCH_2CH_2)_nOH$$

where n has an average value of 4, and nonyl phenol ethoxylate (9.0 moles ethylene oxide).

Further, a mixture of one or more of the above surfactants can be used. Especially preferred surfactants include ethoxylated straight-chain alcohols such as Texaco L-6-7 TM (CTFA name, Surfonic L-46-7), ethoxylated alkyl phenols such as Texaco NP-4 TM (CTFA name, Nonoxynol-4), and mixtures thereof.

The total concentration of these surfactants is not particularly critical and may vary widely depending on the hardness desired for the stearate matrix, as will be recognized by one skilled in the art. Preferred total amounts range from between about 20 and about 35% by weight, more preferably about 25 to 30% and, most preferably, about 30% by weight.

The enzymes used in the invention include such enzymes as are commonly known to those who work in the laundering and dry cleaning arts, such as proteases, lipases and amylases, which may be in a stabilized blend or may be an unstabilized preparation with calcium salts added for stabilization. Proteases and amylases are preferred enzymes. Proteases, enzymes which alter protein-derived stains and soils, are particularly preferred since, once the proteins have been degraded, the surfactant is more likely to clean the remaining soils and stains.

Specific useful enzyme systems include an enzyme material supplied by Novo Nordisk in Danbury, Conn., under the name Alcamyl TM, and an enzyme material also supplied by the Novo Nordisk Company under the name Savinase TM. Alcamyl TM is a mixture of Novo Nordisk's Alcalase TM and Termamyl TM enzymes. Alcalase is a proteolytic enzyme; Termamyl TM is an amyolytic enzyme. Proteolytic enzymes break down proteins to soluble components; amyolytic enzymes hydrolyze starches, rapidly breaking them down to soluble dextrins and oligo saccharides.

Savinase is a proteolytic enzyme, specifically an endo-protease of the serine type. Savinase hydrolyzes the protein in the stains, forming peptides which are readily soluble during cleaning.

Preferably, the amount of enzymes used in the composition of the invention is between about 2 and about 10% by weight and, more preferably, between about 3 and about 5% by weight.

The composition of the invention includes water in an amount higher than that typically encountered in stearate matrix-type products, i.e., preferably, from about 25 to about 30% by weight, more preferably, about 26 to about 27% by weight. Most preferably, the amount of water is about 26.5% by weight. Generally, the amount of water should be sufficient to contribute desirably to the yieldability of the stearate matrix.

The compositions may be further enhanced for use by consumers by adding small amounts of a fragrance, preferably a fruity, clean or sanitizing scent, most preferably a citrus-type scent. When a fragrance is used, the concentration will depend on the type and strength of scent produced by the particular additive used. However, typically, when a fragrance is present, it is used in an amount between about 0.05 and about 2% by weight, with a concentration of about 0.5 to about 1.5% by weight being preferred.

In pre-spotting and other laundry-type products, the final product is often translucent to opaque. Accordingly, a dye may be added so that the user can see where the composition has been applied. Further, traditional coloring agents can be added to provide a more desirable color or one that would be judged by the consumer as appropriate or more pleasing for a laundry product. Examples of useful coloring agents include titanium dioxide, pearlescent agents of the type customarily used in the cosmetic and soap industry, various organic dyes commonly used in laundry and detergent products, and other coloring and opacifying agents that would give color to the product, but which would not dye, discolor, or otherwise damage the fabric on which the composition is used.

When coloring agents are present, they are generally used in an amount between about 0.001% and about 0.005% by weight. Preferably, the coloring agent is an organic dye and is present in an amount of about 0.004% by weight of the total composition.

Detergent builders can also be added to the pre-spotter stick composition of the invention. Particularly useful builders include sodium bicarbonate and citric acid and its salts. When present, the builder is typically included in the composition in concentrations ranging from about 0.01 to about 10% by weight.

An antioxidant, such as sodium thiosulfate, may also be useful in the composition as a preservative. When present, the antioxidant is generally incorporated in an amount which is on the order of about 0.1% by weight.

The pH of the composition of the invention should be maintained in a range which is not so high as to preclude enzyme activity, but not so low as to produce a solid that is too soft and easily becomes mushy. For these reasons, the pH should preferably be between about 9.0 and about 9.6, even more preferably, between about 9.1 and about 9.5. (The pH is tested using a 1% solution in deionized water.)

The compositions of the invention are typically waxy, greasy, translucent to opaque solids. The temperature sensitivity of the novel composition can be measured in terms of the "drop point", i.e., the temperature at which actual drops of liquid are formed such that, if the generally solid composition were suspended above a surface, the drop formed would fall onto the surface due to the force of gravity. The drop point is usually tested by packing a small quantity of the composition into the closed end of a test tube, inverting the test tube in a container of water, gradually heating the water, and measuring the temperature at which the composition slides out of the test tube. Desirably, the drop point is greater than about 115° F. to maintain the dimensional stability of the composition during shipping and storage, but can be higher as the allowable hardness increases.

Hardness is generally measured in terms of an inverse relationship with "yield" or "penetrability", as determined with a penetrometer using an ASTM standard brass cone (with no additional weight added) and a penetration time of five seconds. The sample for the penetrometer determination is typically poured, while still molten, into a 2½-ounce cylindrical container, allowed to harden at room temperature, and then tested.

In preferred embodiments, the composition provides a relatively soft, but readily malleable material, which is a firm solid, but which is easily applied manually by the user directly to soiled portions of fabric which have been pre-selected for treatment prior to cleaning, preferably producing a glossy sheen on the soiled fabric. The penetrometer reading for stearate matrix consumer goods can vary widely, depending on consumer preferences, between about 30 to 300 units (3 to 30 mm), but preferably is about 50 to 80 units (5.0 to 8.0 mm). However, to meet the requirement for easy physical transferability upon abrasive contact with the fabric to which the composition is to be applied, the penetrometer reading for the composition should most preferably be at least about 55 units (5.5 mm).

The pH, drop point, and penetrometer reading are generally interrelated and interdependent. Thus, the "yield" value measured by the penetrometer cannot usually be changed without affecting one or both of the other two properties, that is, pH and drop point. If one selected a pH in the preferred range and an acceptable drop point for prior art pre-spotting sticks that are based on a stearate matrix carrier, the resulting compositions would be undesirably soft for consistent application or durability of the stick.

Thus, one of ordinary skill in the art would have expected that such pre-spotting sticks would not meet the criterion for sufficient "yield" or a penetrability of about 60 to 80 units. If one desired a product that was more active, for example, exhibit a pH reading of 9.2, the hardness of a conventional formulation would be in an unacceptable range of about 160, resulting in an unacceptable mushy, semi-liquid state. In addition, the drop point would be about 111° F., below the desired minimum drop point of about 115° F. for stability in shipping and warehousing.

In contrast, the compositions of the invention exhibit an excellent balance of higher rigidity, strength and hardness, physical "yield" and transferability, acceptable resistance to the relatively high temperatures that may be encountered during shipping and storage, and a pH conducive to enzyme activity. A particularly preferred embodiment is shown below:

| Ingredient | Approx. % by Wt. |
|---|---|
| Sodium stearate | 12% |
| Propylene glycol | 10% |
| Polyethylene glycol | 5% |
| Alkyl-substituted aromatic sulfonate surfactant (Sodium dodecylbenzenesulfonate) | 15% |
| Strong base (NaOH) | 5% |
| Nonionic surfactant(s) | 30% |
| Enzyme | 5% |
| Water to make | 100% |

The composition of the invention may be prepared by combining most of the water, the propylene glycol and a minor portion of the strong base, preferably about 1.5% of the total composition weight, in a vessel with heating and agitation. The temperature at this point can vary widely, but should be high enough to facilitate dissolution of both of these ingredients while still being below the boiling point of the mixture. Suitable temperatures generally range from about 180° to about 192° F. and, most preferably, are about 190° F.

To this solution is added slowly (1) the sodium stearate with increased agitation and (2) then the polyethylene glycol. At each of these stages, it is preferable to continue heating and agitation, first until the sodium stearate has been completely dissolved to form a clear solution, and then until the polyethylene glycol is completely dissolved to form a clear solution. The time required for each of these steps can vary widely depending on the temperature, the agitation, and the relative amounts of the ingredients in the composition. Generally, however, the time for each step runs between 15 to about 45 minutes, most preferably from about 20 to about 30 minutes. The temperature may be increased somewhat within the above range to assure that both the sodium stearate and the polyethylene glycol are well dissolved, for example, from about 185° F. to about 190° F.

The warm solution is then cooled slightly, typically to a temperature from about 160° to about 180° F., most preferably about 170° F., and all surfactants are added, including the alkyl-substituted aromatic sulfonic acid, sulfonate, or mixture thereof. As the temperature gradually drops to room temperature, further additives, such as fragrance or coloring agents, are mixed in, and the pH is adjusted with the remaining portion of the strong base to a value within a range of from about 9.0 to about 9.6, preferably from about 9.1 to about 9.5. After sufficient additional agitation to assure complete mixing, and while still sufficiently warm to be pourable, the composition is cast into appropriate mold-like containers with the enzyme for forming applicator sticks and then allowed to cool to room temperature to solidify. The enzyme is quickly mixed and then dispensed into the container in such a fashion that the enzyme remains substantially active, as described in U.S. Pat. No. 5,046,538 issued on Sep. 10, 1991 to Allison et al., the disclosure of which is hereby incorporated by reference.

According to the process of the invention for cleaning fabric that has soiled portions, the composition of the invention is applied to the soiled portions of the fabric prior to cleaning and then the soiled fabric to which the composition has been applied is laundered or dry cleaned. Thus, the stick applicator of the invention is used contactingly to apply the spot- and stain-removing composition of the invention to selected areas of soiled fabric prior to subjecting the fabric to a cleaning operation.

According to this method, the composition can be applied to almost any type of fabric that can be either laundered in an aqueous detergent solution or dry cleaned in any one of a number of organic solvent based cleaning compositions. Such fabrics include cotton, wool, rayon, silk, synthetics fibers such as nylon, polyester or polyester knit, and mixtures thereof, such as 65/35 Kodel TM /cotton or 65/35 Dacron/cotton.

The composition can be applied to one or more soiled portions of the fabric at almost any convenient temperature, for example, at any temperature between the freezing point of water at 32° F. and the drop point temperature of the composition (at least 115° F.). Further, the temperature at which the composition can be applied will depend upon the fabric being treated and the type of laundering or dry cleaning process that will be used to clean the fabric. Preferably, however, the composition is applied to the fabric at a temperature between about 40° and 100° F. and, most preferably, is applied at about room temperature.

The composition may be applied with widely varying coverages. The amount of the composition applied should be sufficient to adequately cover heavily soiled portions of the fabric. Thus, at the upper end of the scale, the amount is limited primarily by economic rather than technical considerations. Typically, the composition is applied for a coverage varying from about 0.08 to about 0.15 gram per square centimeter of fabric, with a coverage of about 0.10 gram per square centimeter being generally employed. The optimum coverage is that which results in a waxy sheen on the stain.

After application to the soiled portion of the fabric, the composition is typically readily removed by laundering or dry cleaning the fabric with products customarily used in these arts. Preferably, the residue is removed by laundering with an aqueous solution that contains a combination of detergents, salts, surfactants and/or solvents at typical laundering temperatures.

As to dwell time, the fabric may be successfully cleaned within a time period of only a few minutes. No disadvantages are known to result from delaying the laundering step for a significant period of time, for example, for as long as about a week. In fact, an important practical advantage of the solid stick-type pre-spotting compositions is that they may be applied several days before subjecting the treated fabric to laundering with no adverse effects.

On the other hand, no inconvenient dwell time or residence time is required after the composition has been applied to the soiled portion of the fabric. Thus, after the composition has been applied to the fabric, the fabric may be cleaned as soon as is convenient. The optimum time for application is any time between about one minute and one week before the cleaning operation.

The compositions of the invention are useful in effectively removing a broad spectrum of soils, including milk, blood, cocoa, and sugar, as well as grass stains. The compositions are also effective in facilitating the removal of grape juice stains, mustard spills, sebum, crayon, lipstick, and salad dressing.

However, the efficacy of the composition and method of use against other soils can be easily tested by applying a test preparation of the soil in question on a cotton swatch, applying the composition of the invention, and washing the swatch in 150 ppm hardness water at 100° F. in a Tergotometer beaker, with 100 cycles per minute of agitation and about 1.5 g/l of a non-phosphate powdered commercial detergent, such as Tide in hot water or Cold Power in cold water (both of which contain only about 8.7% phosphorus). Alternatively, test swatches can be graded for stain removal efficiency on a scale of "1" (complete stain removal) to "5" (no stain removal). Results are often reported as percent stain removal.

The invention will be further clarified by the following examples, which are intended to be purely exemplary of the invention.

EXAMPLE 1—PREPARATION OF THE COMPOSITION OF THE INVENTION

A composition of the present invention was prepared by heating 795 pounds of deionized water to 180° F. in a suitable stainless steel vessel equipped with turbine agitation and adding 300 pounds of propylene glycol. While reheating to 185° F., 45 pounds of NaOH (50%) were added under agitation. When the mixture reached 186° F., 360 pounds of sodium stearate C-1 were slowly added, and mixing was increased until the mixture was clear (approximately 35 minutes). With the mixture at 185° F., 140 pounds of polyethylene glycol (PEG 20,000) TM were added. Mixing was continued for approximately 40 minutes until the mixture was again clear.

When the mixture had cooled to 170° F., 450 pounds of Surfonic TM NP-4 were added under continued mixing, followed by the addition of 450 pounds of Surfonic TM L-46-7 and then 450 pounds of CalSoft TM S-100, both under continued mixing. The mixture was permitted to cool to 135° F., whereupon 93 pounds of NaOH were added, increasing the pH from an initial reading of 7.4 to a final reading of 9.5. This was followed by the addition of 20 pounds of a fragrance, concluding with 10 minutes of mixing. The batch weight was 3.085 pounds prior to the addition of the enzyme. Finally, when the temperature was between 125° and 138° F., the enzyme Alcamyl TM was added at 5% of the canister weight at the filler.

The resulting product had the following composition:

| COMPONENT | PERCENT BY WEIGHT |
|---|---|
| DI Water | 24.2% |
| Propylene Glycol | 9.1% |
| NaOH (50%) | 4.6% |
| Sodium Stearate C-1 | 11.0% |
| PEG 20,000 | 4.6% |
| Surfonic NP-4 | 13.7% |
| Surfonic L-46-7 | 13.7% |
| CalSoft S-100 | 13.7% |
| Fragrance | 0.9% |
| Alcamyl | 4.6% |

EXAMPLE 2—PERFORMANCE TESTING OF THE COMPOSITION OF THE INVENTION

The efficacy of the composition described in Example 1 was compared to two conventional stick application stain removers and a control, according to the following procedure at an independent testing laboratory.

Stained fabric swatches of cotton and poly/cotton material were allows to set for 24 hours. The stains were then rubbed with the stain removers according to directions and washed with standard AATCC detergent. Samples were run in triplicate. One control swatch for each stain and each fabric sample was run and washed only with the standard detergent. Seven standard stains were used: grass, grape juice, spaghetti sauce, chocolate syrup, blood, black clay, and gravy.

The swatches obtained after laundering were each graded by a panel of five people using a 1 to 5 rating scale with "1" indicating complete stain removal and "5" indicating no stain removal. The results showed the composition of the invention to be clearly superior to conventional sticks in the removal of some stains, e.g., the removal of tomato sauce and chocolate syrup from both cotton and poly/cotton fabrics and the removal of blood, clay and grape juice from poly/cotton fabric. On other stain/material combinations, the formulation of the invention generally was equal to one or the other of the conventional sticks.

Overall efficacy was gauged by adding the results from the seven stains on each type of fabric and converting to % stain removal. The average percent stain removal for each stain remover was calculated by adding the seven ratings (one for each type of stain) and calculating the percentage this total represented of the numerical spread between 35 and 7. Thus, the possible rating extremes were "35", representing stain removal, and "7", representing 100% stain removal.

For example, a total of "21" represented 50% stain removal [35−21=14; (35−7)=28; 14 divided by 28=50%]. The results so calculated for the three stain removers and the control are listed in the following Table II (based upon the raw data as presented in Table I):

TABLE I

| | Raw Data | | |
|---|---|---|---|
| | | Cotton | Poly/Cotton |
| Grass Stain | A | 3.0 | 1.86 |
| | B | 2.56 | 1.53 |
| | C | 3.76 | 3.4 |
| Control | | 3.8 | 2.5 |

TABLE I-continued

| | | Raw Data | |
|---|---|---|---|
| | | Cotton | Poly/Cotton |
| Grape Juice | A | 3.2 | 2.33 |
| | B | 2.93 | 2.66 |
| | C | 3.4 | 2.7 |
| Control | | 3.1 | 2.3 |
| Clay | A | 2.73 | 1.56 |
| | B | 2.76 | 1.7 |
| | C | 2.7 | 1.96 |
| Control | | 2.1 | 1.6 |
| Gravy | A | 2.6 | 1.53 |
| | B | 2.56 | 1.9 |
| | C | 2.86 | 1.5 |
| Control | | 2.8 | 1.5 |
| Tomato sauce | A | 2.86 | 1.07 |
| | B | 3.26 | 1.26 |
| | C | 3.16 | 1.2 |
| Control | | 3.3 | 1.3 |
| Chocolate Syrup | A | 2.8 | 1.26 |
| | B | 3.2 | 1.86 |
| | C | 2.9 | 1.93 |
| Control | | 3.3 | 2.2 |
| Blood | A | 1.6 | 1.0 |
| | B | 1.56 | 1.1 |
| | C | 1.4 | 2.86 |
| Control | | 1.7 | 1.0 |

TABLE II

| | % Stain Removal | | | |
|---|---|---|---|---|
| | Cotton | | Poly/Cotton | |
| | Total of Ratings | % Stain Removal | Total of Ratings | % Stain Removal |
| Composition of the Invention | 18.79 | 57.9% | 10.61 | 87.1% |
| Conventional Stick B | 18.83 | 57.8% | 12.01 | 82.1% |
| Conventional Stick A | 20.18 | 52.9% | 15.55 | 69.5% |
| Control | 20.10 | 53.2% | 12.40 | 80.7% |

The data indicated that the formulation of Example 1 was equal to or better than the conventional formulations with respect to cotton; was clearly better than the conventional formulations as to poly/cotton; and enhanced the stain removing power of plain detergent by about 8.9%.

EXAMPLE 3—TEST RESULTS—PHYSICAL/MECHANICAL PROPERTIES

The utility of the composition is dependent on the activity of the enzymes, which is restricted by excessively high pH. The lower the pH, the more active and better performing the enzyme. The lower limit of pH is dictated by the required application characteristics of the solid stick. Previously, at a pH of about 9.2 or lower, the stearate matrix materials would have had insufficient hardness (about 160) to maintain the rigidity needed for the composition to maintain the stick form, and drop points so low (about 111° F.) as to be unable to withstand conventional storage and shipping temperatures. However, the composition of the invention maintained sufficient rigidity, hardness, and drop point, even when pH is as low as 9.0. This improvement is illustrated by test results comparing pH, hardness, and drop point of the composition of the invention to that of compositions previously possible, as shown by the following results:

TABLE III

| | Drop Point | | Hardness (Penetration) | |
|---|---|---|---|---|
| pH | Product of Current Invention | Expected From Prior Art | Product of Current Invention | Expected From Prior Art |
| 8.1 | 100° F. | — | 148 units | — |
| 8.2 | 102° F. | — | 140 units | — |
| 8.7 | 108° F. | — | 94 units | — |
| 8.9 | 116° F. | 111° F. | 84 units | — |
| 9.1 | 124° F. | 115° F. | 70 units | 140 |

(The results expected from prior art are based on FIG. 1, U.S. Pat. No. 4,842,762, which used a Mettler Thermosystem to determine drop points. Drop points may vary as much as 2 to 3 points when different measurement systems are used.)

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A soil and stain remover composition in applicator stick form for application to fabric as an aid in cleaning, said composition comprising:

a. from about 11 to about 15% by weight of sodium stearate;

b. from about 8 to about 11% by weight of propylene glycol;

c. from about 4 to about 7% by weight of a polyethylene glycol;

d. from about 12 to about 20% by weight of an alkyl aromatic sulfonic acid surfactant, an alkyl aromatic sulfonate surfactant that has been formed in situ by the reaction of said alkyl aromatic sulfonic with a strong base, or a mixture thereof;

e. from about 2 to about 6% by weight of a strong base capable of reacting in situ with said alkyl aromatic sulfonic acid surfactant to form a semi-solid sulfonate product;

f. from about 20 to about 35% by weight of at least one nonionic surfactant, wherein said nonionic surfactant is different from said alkyl aromatic sulfonic acid surfactant or said alkyl aromatic sulfonate surfactant above;

g. from about 2 to about 10% by weight of an enzyme; and h. from about 24 to about 30% by weight water;

wherein said composition has a pH of between about 9.0 and about 9.6, a drop point of greater than about 115° F., and a penetrometer reading of at least about 55 units (5.5 mm).

2. The composition of claim 1, wherein the sodium stearate is present in the amount of about 12% by weight.

3. The composition of claim 1, wherein the propylene glycol is present in an amount of about 10% by weight.

4. The composition of claim 1, wherein the polyethylene glycol has a molecular weight of at least 3235.

5. The composition of claim 1, wherein the polyethylene glycol is present in an amount of about 5% by weight.

6. The composition of claim 1, wherein:

a. any alkyl aromatic sulfonic acid surfactant present is selected from the group consisting of alkyl benzenesulfonic acids and alkyl toluenesulfonic acids and b. any alkyl aromatic sulfonate surfactant present is selected from the group consisting of alkyl benzenesulfonates and alkyl toluenesulfonates.

7. The composition of claim 1, wherein the total amount of the alkyl aromatic sulfonic acid surfactant and alkyl aromatic sulfonate surfactant present is about 15% by weight.

8. The composition of claim 1, wherein the strong base is an alkali metal hydroxide.

9. The composition of claim 1, wherein the strong base is sodium hydroxide.

10. The composition of claim 1, wherein the strong base is present in the amount of about 4.5% by weight.

11. The composition of claim 1, wherein the nonionic surfactant is selected from the group consisting of ethoxylated and propoxylated straight-chain alcohols and ethoxylated alkylphenols.

12. The composition of claim 1, wherein the nonionic surfactant is a mixture of an ethoxylated straight chain alcohol and an ethoxylated alkyl phenol.

13. The composition of claim 1, wherein the total amount of said nonionic surfactants present, except for any alkyl aromatic sulfonic acid or alkyl aromatic sulfonate surfactant, is about 25 to 30% by weight.

14. The composition of claim 1, wherein the enzyme is selected from the group consisting of proteases, lipases and amylases.

15. The composition of claim 1, wherein the enzyme is a protease or an amylase.

16. The composition of claim 1, wherein the enzyme is present in an amount of about 3 to about 5% by weight.

17. The composition of claim 1, further comprising a fragrance.

18. The composition of claim 1, further comprising a coloring agent.

19. The composition of claim 1, wherein water is present in an amount from about 26 to about 27% by weight.

20. The composition of claim 1, wherein the pH in between about 9.1 and about 9.5.

21. A laundry soil and stain remover composition in applicator stick form for application to fabric as an aid in laundering, said composition comprising:

a. about 12% by weight of sodium stearate;

b. about 10% by weight of propylene glycol;

c. about 5% by weight of a polyethylene glycol;

d. about 15% by weight of an alkyl aromatic sulfonic acid surfactant, an alkyl aromatic sulfonate surfactant, or a mixture thereof;

e. about 5.0% by wight of a strong base capable of reacting in situ with said alkyl aromatic sulfonic acid surfactant or the sulfonic acid corresponding to said alkyl aromatic sulfonate to form a semi-solid sulfonate product;

f. about 30% by weight of at least one nonionic surfactant, wherein each said nonionic surfactant is different from said alkyl aromatic sulfonic acid surfactant or said alkyl aromatic sulfonate surfactant above;

g. from about 3 to about 5% by weight of an enzyme; and h. from about 26 to about 27% by weight water, wherein the composition exhibits a drop point greater than about 115° F. and a penetrometer reading of at least about 55 units (5.5 mm).

22. The composition of claim 21, wherein:

a. said polyethylene glycol has a molecular weight of at least about 3235;

b. said alkyl aromatic sulfonic acid surfactant is dodecyl benzenesulfonic acid and said alkyl aromatic sulfonate surfactant is sodium dodecylbenzenesulfonate;

c. said strong base is sodium hydroxide;

d. said nonionic surfactant comprises a mixture of about 15% by weight of an ethoxylated straight chain alcohol and about 15% by weight of an ethoxylated alkyl phenol;

e. said enzyme is predominantly a protease or an amylase; and f. said composition further comprises about 1% by weight of a fragrance.

23. A process for cleaning fabric, said fabric having soiled portions, said process comprising the steps of:

a. applying to the soiled portions of said fabric, prior to cleaning, a soil and stain remover composition in applicator stick form, said composition comprising:

i. from about 11 to about 15% by weight of sodium stearate;

ii. from about 8 to about 11% by weight of propylene glycol;

iii. from about 4 to about 7% by weight of a polyethylene glycol;

iv. from about 12 to about 20% by weight of an alkyl aromatic sulfonic acid surfactant, an alkyl aromatic sulfonate surfactant that has been formed in situ by the reaction of said alkyl aromatic sulfonic acid with a strong base, or a mixture thereof;

v. from about 2 to about 6% by weight of a strong base capable of reacting in situ with said alkyl aromatic sulfonic acid surfactant to form a semi-solid sulfonate product;

vi. from about 20 to about 35% by weight of at least one nonionic surfactant, wherein said nonionic surfactant is different from said alkyl aromatic sulfonic acid surfactant or said alkyl aromatic sulfonate surfactant above;

vii. from about 2 to about 10% by weight of an enzyme; and viii. from about 24 to about 30% by weight water, wherein said composition has a pH of between about 9.0 and about 9.6, a drop point of greater than about 115° F., and a penetrometer reading of at least about 55 units (5.5 mm); and b. cleaning the soiled fabric to which said composition has been applied by laundering or dry cleaning.

24. The process of claim 23, wherein the sodium stearate is present in the amount of about 12% by weight.

25. The process of claim 23, wherein the, polyethylene glycol has a molecular weight of at least 3235.

26. The process of claim 23, wherein the polyethylene glycol is present in an amount of about 5% by weight.

27. The process of claim 23, wherein the total amount of any alkyl aromatic sulfonic acid surfactant and any alkyl aromatic sulfonate surfactant present is about 15% by weight.

28. The process of claim 23, wherein the strong base is sodium hydroxide.

29. The process of claim 23, wherein the total amount of said nonionic surfactants, except for any alkyl aromatic sulfonic acid or alkyl aromatic sulfonate surfactant present, is about 30% by weight.

30. The process of claim 23, wherein the enzyme is present in an amount of about 3 to about 5% by weight.

31. The process of claim 23, wherein the composition further comprises a fragrance.

32. The process of claim 23, wherein water is present in an amount from about 26 to about 27% by weight.

33. The process of claim 23, wherein the laundry soil and stain remover composition in an applicator stick comprises:

a. about 12% by weight of sodium stearate;
b. about 10% by weight of propylene glycol;
c. about 5% by weight of a polyethylene glycol;
d. about 15% by weight of an alkyl aromatic sulfonic acid surfactant, an alkyl aromatic sulfonate surfactant, or a mixture thereof;
e. about 5.0% by weight of a strong base capable of reacting in situ with said alkyl aromatic sulfonic acid surfactant or the sulfonic acid corresponding to said alkyl aromatic sulfonate to form a semi-solid sulfonate product;
f. about 30% by weight of at least one nonionic surfactant, wherein said nonionic surfactant is different from said alkyl aromatic sulfonic acid surfactant or said alkyl aromatic sulfonate surfactant above;
g. from about 3 to about 5% by weight of an enzyme; and
h. from about 26 to about 27% by weight water.

34. The process of claim 23, wherein the time between said applying step and said cleaning step is one week or less with no physical damage to said fabric after said cleaning step.

35. The process of claim 34, wherein the time between said applying step and said cleaning step is between about one minute and one week.

36. The process of claim 23, wherein, after said applying step, the applied coverage of the composition on the soiled portion of the fabric falls within the range of from about 0.08 to about 0.15 gram per square centimeter of

37. The process of claim 23, wherein the temperature during said applying step is about room temperature.

38. The process of claim 23, wherein said cleaning step is accomplished by laundering.

39. A laundry soil and stain remover composition in applicator stick form for application to fabric as an aid in laundering, said composition comprising:

a. 11.0% by weight sodium stearate;
b. 9.1% by weight propylene glycol;
c. 4.46% by weight polyethylene glycol;
d. 1.37% by wight of an alkyl aromatic sulfonic acid surfactant, an alkyl aromatic sulfonate surfactant, or a mixture thereof;
e. 4.6% by weight of a strong bore capable of reaching in situ with said alkyl aromatic sulfonic acid surfactant to form a semi-solid sulfonate product;
f. 27.7% by weight of at least one nonionic surfactant, wherein each said nonionic surfactant is different from said alkyl aromatic sulfonic acid surfactant above;
g. 4.6% by weight of an enzyme;
h. 0.9% by weight of a fragrance; and
i. 24.2% by weight deionized water, wherein the composition exhibits a drop point greater than about 115° F. and a penetrometer reading of at least about 55 units (5.5 mm).

40. A process for preparing a soil and stain remover composition for application to fabric, said composition comprising:

a. from about 11 to about 15% by weight of sodium stearate;
b. from about 8 to about 11% by weight of propylene glycol;
c. from about 4 to about 7% by weight of a polyethylene glycol;
d. from about 12 to about 20% by weight of an alkyl aromatic sulfonic acid surfactant, an alkyl aromatic sulfonate surfactant that has been formed in situ by the reaction of said alkyl aromatic sulfonic acid with a strong base, or a mixture thereof;
e. from about 2 to about 6% by weight of a strong base capable of reacting in situ with said alkyl aromatic sulfonic acid surfactant to form a semi-solid sulfonate product;
f. from about 20 to about 35% by weight of at least one nonionic surfactant, wherein said nonionic surfactant is different from said alkyl aromatic sulfonic acid surfactant or said alkyl aromatic sulfonate surfactant above;
g. from about 2 to about 10% by weight of an enzyme; and
h. from about 24 to about 30% by weight water;

wherein said composition has a pH of between about 9.0 and about 9.6, a drop point of greater than about 115° F., and a penetrometer reading of at least about 55 units (5.5 mm), said process comprising the steps of:

(1) combining most of the water, the propylene glycol and a minor portion of the strong base with heat and agitation;
(2) adding the sodium stearate;
(3) adding the polyethylene glycol;
(4) adding the surfactants "d." and "f." above;
(5) adding a major portion of the strong base to adjust the pH to a value within a range of from about 9.0 to about 9.6; and
(6) adding the enzyme and, simultaneously with the adding of the enzyme, casting the composition into a container.

41. The process of claim 40, wherein the sodium stearate is present in the amount of about 12% by weight.

42. The process of claim 40, wherein the propylene glycol is present in an amount of about 10%.

43. The process of claim 40, wherein the polyethylene glycol has a molecular weight of at least 3235.

44. The process of claim 40, wherein:

a. any alkyl aromatic sulfonic acid surfactant present is selected from the group consisting of alkyl benzenesulfonic acids and alkyl toluenesulfonic acids; and
b. any alkyl aromatic sulfonate surfactant present is selected from the group consisting of alkyl benzenesulfonates and alkyl toluenesulfonates.

45. The process of claim 40, wherein the strong base is sodium hydroxide.

46. The process of claim 40, wherein the nonionic surfactant is selected from the group consisting of ethoxylated and propoxylated straight-chain alcohols and ethoxylated alkylphenols.

47. The process of claim 40, wherein the enzyme is a protease or an amylase.

48. The process of claim 40, wherein, in step (1), the amount of strong base added is about 1.5% by weight.

49. The process of claim 40, wherein, in step (1), the temperature ranges from about 180° to about 192° F.

50. The process of claim 40, wherein, after the sodium stearate is added in step (2), the resulting mixture is heated and agitated until the sodium stearate has been completely dissolved.

51. The process of claim 40, wherein, after the polyethylene glycol is added in step (3), the resulting mixture is heated and agitated until the polyethylene glycol is completely dissolved.

52. The process of claim 40, wherein, during the addition of the surfactants in step (4), the temperature ranges from about 160° to about 180° F.

53. The process of claim 40, wherein, during step (5), the pH is adjusted to a range of from about 9.1 to about 9.5.

54. The process of claim 40, wherein the enzyme is added in such a fashion that the enzyme remains substantially active.

55. A process for cleaning fabric, said fabric having soiled portions, said process comprising the steps of:

a. applying to the soiled portions, prior to cleaning, a soil and stain remover composition in applicator stick form, said composition comprising:
   i. from about 11 to about 15% by weight of sodium stearate;
   ii. from about 8 to about 11% by weight of propylene glycol;
   iii. from about 4 to about 7% by weight of a polyethylene glycol;
   iv. from about 12 to about 20% by weight of an alkyl aromatic sulfonic acid surfactant, an alkyl aromatic sulfonate surfactant that has been formed in situ by the reaction of said alkyl aromatic sulfonic acid with a strong base, or a mixture thereof;
   v. from about 2 to about 6% by weight of a strong base capable of reacting in situ with said alkyl aromatic semi-solid sulfonate product;
   vi. from about 20 to about 35% by weight of at least one nonionic surfactant, wherein said nonionic surfactant is different from said alkyl aromatic sulfonic acid surfactant or said alkyl aromatic sulfonate surfactant above;
   vii. from about 2 to about 10% by weight of an enzyme; and
   viii. from about 24 to about 30% by weight water;
   wherein said composition has a pH of between about 9.0 and about 9.6, a drop point of greater than about 115° F., and a penetrometer reading of at least about 55 units (5.5 mm); and b. cleaning the soiled fabric to which said composition has been applied by laundering or dry cleaning.

56. The process of claim 55, wherein the sodium stearate is present in the amount of about 12% by weight.

57. The process of claim 55, wherein the propylene glycol is present in an amount of about 10%.

58. The process of claim 55, wherein the polyethylene glycol has a molecular weight of at least 3235.

59. The process of claim 55, wherein:

a. any alkyl aromatic sulfonic acid surfactant present is selected from the group consisting of alkyl benzenesulfonic acids and alkyl toluenesulfonic acids and b. any alkyl aromatic sulfonate surfactant present is selected from the group consisting of alkyl benzenesulfonates and alkyl toluenesulfonates.

60. The process of claim 55, wherein the strong base is sodium hydroxide.

61. The process of claim 55, wherein the nonionic surfactant is selected from the group consisting of ethoxylated and propoxylated straight-chain alcohols and ethoxylated alkylphenols.

62. The process of claim 55, wherein the enzyme is a protease or an amylase.

63. The process of claim 55, wherein the fabric is selected from the group consisting of cotton, wool, rayon, silk, synthetic fibers and mixtures thereof.

64. The process of claim 55, wherein, during said applying step, the temperature is about room temperature.

65. The process of claim 55, wherein, after said applying step, the applied coverage of the composition on the soiled portion of the fabric is sufficient to result in a waxy sheen on the treated portion of the fabric.

66. The process of claim 65, wherein the coverage of the composition varies from about 0.08 to about 0.15 gram per square centimeter of fabric.

67. The process of claim 55, wherein said cleaning step is laundering.

68. The process of claim 67, wherein, in said cleaning step, the fabric is laundered with an aqueous solution that contains at least one detergent and at least one surfactant or solvent.

69. The process of claim 55, wherein the time between said applying step and said cleaning step is at least one day.

70. The process of claim 69, wherein the time between said applying step and said cleaning step is between one day and two weeks with no significant physical damage to said fabric after said cleaning step.

71. The process of claim 55, wherein the composition is in solid stick form and is manually applied by the user.

* * * * *

UNITED STATES PATENT AND TRADEMARK OFFICE

CERTIFICATE OF CORRECTION

PATENT NO. : 5,288,420

DATED : February 22, 1994

INVENTOR(S) : John C. Mandy

It is certified that error appears in the above-indentified patent and that said Letters Patent is hereby corrected as shown below:

COLUMN 1

Line 50, "and," should read --and--.
Line 61, "Sabol et al.," should read --Sabol Jr. et al.,--.

COLUMN 2

Line 4, "I5" should be deleted.
Line 39, "(5.5" should read --(5.5mm).--.

COLUMN 4

Line 13, "is to" should be deleted.
Line 15, "semi solid" should read --semi-solid--.
Line 66, "L-6-7" should read --L-46-7--.

COLUMN 5

Line 25, "Alcalase" should read --Alcalase™--.
Line 30, "Savinase" should read --Savinase™--.
Line 31, "Savinase" should read --Savinase™--.

COLUMN 7

Line 36, "water to make" should read --water to make 100%-- and "100%" should be deleted

UNITED STATES PATENT AND TRADEMARK OFFICE

CERTIFICATE OF CORRECTION

PATENT NO. : 5,288,420

DATED : February 22, 1994

INVENTOR(S) : John C. Mandy

It is certified that error appears in the above-indentified patent and that said Letters Patent is hereby corrected as shown below:

COLUMN 8

Line 34, "synthetics" should read --synthetic--.

COLUMN 9

Line 67, "3.085 pounds" should read --3,085 pounds--.

COLUMN 10

Line 54, "representing" should read --representing 0%--.

COLUMN 12

Line 37, "sulfonic" should read --sulfonic acid--.

COLUMN 13

Line 42, "in" should read --is--.
Line 53, "wight" should read --weight--.

COLUMN 15

Line 53, "1.37%" should read --13.7%--, and
"wight" should read --weight--.
Line 56, "bore" should read --base--, and
"reach-" should read --react- --

UNITED STATES PATENT AND TRADEMARK OFFICE

CERTIFICATE OF CORRECTION

PATENT NO. : 5,288,420

DATED : February 22, 1994

INVENTOR(S) : John C. Mandy

It is certified that error appears in the above-indentified patent and that said Letters Patent is hereby corrected as shown below:

COLUMN 16

Line 26, "water;" should read --water,--.

COLUMN 17

Line 51, "water;" should read --water,--.

COLUMN 18

Line 14, "acids" (second occurrence) should read --acids;--.

Signed and Sealed this

Eighteenth Day of October, 1994

*Attest:*

*Attesting Officer*

BRUCE LEHMAN

*Commissioner of Patents and Trademarks*